United States Patent [19]

Kruehn et al.

[11] Patent Number: 4,603,566

[45] Date of Patent: Aug. 5, 1986

[54] SAFETY LOCK

[75] Inventors: Juergen Kruehn, Berlin, Fed. Rep. of Germany; Kurt Prunbauer, Herzogenburg, Austria

[73] Assignee: Zeiss Ikon AG, Fed. Rep. of Germany

[21] Appl. No.: 735,793

[22] Filed: May 17, 1985

[30] Foreign Application Priority Data

May 19, 1984 [DE] Fed. Rep. of Germany ..... 3418680

[51] Int. Cl.[4] ..... E05B 17/04

[52] U.S. Cl. ..... 70/380; 70/372

[58] Field of Search ..... 70/380, 379 R, 379 A, 70/375, 373, 374, 372

[56] References Cited

U.S. PATENT DOCUMENTS 3,429,154 2/1969 Schwartz ..... 70/375
4,472,953 9/1984 Gater ..... 70/373

FOREIGN PATENT DOCUMENTS 1738912 1/1957 Fed. Rep. of Germany .
6944665 2/1970 Fed. Rep. of Germany .
2727566 1/1979 Fed. Rep. of Germany ..... 70/380

*Primary Examiner*—Robert L. Wolfe
*Attorney, Agent, or Firm*—Hill, Van Santen, Steadman & Simpson

[57] ABSTRACT

An improvement for a safety lock is provided which is especially useful in a double cylinder lock having a longitudinally split lock web ring, wherein the ring has a releasable interlocking connection in the form of a hinge at one side and a pair of radially extending pegs on an opposite side which can be clamped together by a retainer in the form of a washer or a clamp to secure the two halves together. If a washer is used, the pegs may have to be swedged over, but if a clamp is used in the form of a resilient member surrounding a portion of the lock ring, no swedging is required.

18 Claims, 8 Drawing Figures

Fig.6
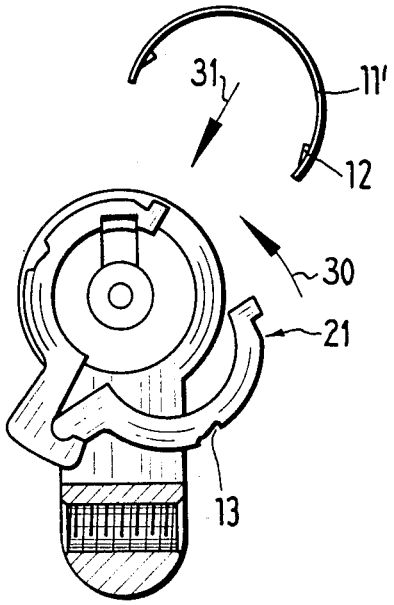
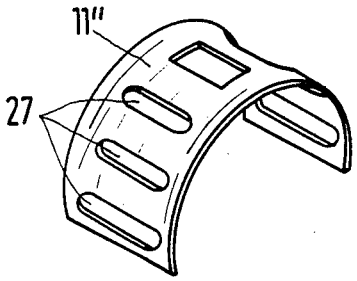
Fig.7
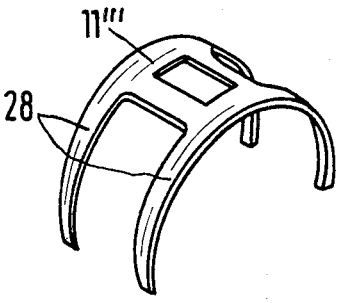
Fig.8

SAFETY LOCK

BACKGROUND OF THE INVENTION

1. Field of the Invention

The present invention relates to a lock cylinder, particularly a double cylinder, wherein a lock web ring is divided in a longitudinal direction and carries a lock web which is held together by retaining elements.

2. Description of the Prior Art

Lock cylinders having lock web rings which are divided in a longitudinal direction or in a central longitudinal section plane are known, for instance as disclosed in German utility models Nos. 69 44 665 and 17 38 912. In utility model No. 69 44 665 the parts of the lock web ring are connected by screws. This type of connection is mechanically involved and very disadvantageous in terms of time and cost required for assembly. Screws are also required in German utility model No. 17 38 912 in order to fasten the lock web ring, which is constructed similarly to a pipe clamp, to the inside cylinder.

SUMMARY OF THE INVENTION

It is an object of the invention to provide a lock web ring for a double cylinder lock wherein the lock web ring is divided in a longitudinal direction and the assembly of the ring can be carried out in a simple, non-time-consuming manner. To achieve this object, the lock web ring is divided in half at a hinge or articulation in the region of the lock web and has radially projecting pegs on each half at the region opposite the lock web, the pegs being held together by a washer or lug which can slip over the pegs. The washer or lug may be integrated in a clamp or clasp which largely surrounds the parts of the lock web ring. The clasp may have latch projections which are to be received in recesses in the lock web ring.

The clamp or clasp may further be fabricated with openings along its length to increase the spring properties of the clamp to ensure that it will remain clamped onto the lock web ring. Also, the clamp or clasp can have spring legs extending from the main body of the clamp to improve the spring properties.

BRIEF DESCRIPTION OF THE DRAWINGS

FIG. 6 is an end view of the lock web ring of FIG. 5 in assembly.

FIG. 7 is a perspective view of a modified clamp.

FIG. 8 is a perspective view of a further modified clamp.

DESCRIPTION OF THE PREFERRED EMBODIMENTS

Figure 1:
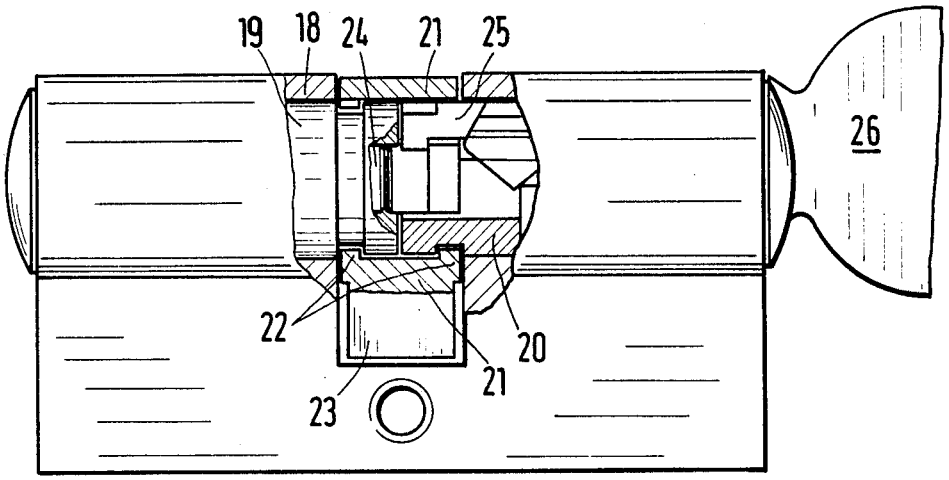
FIG. 1 is a side elevational view, partially cut away, of a double lock cylinder incorporating the principles of the present invention.

FIG. 1 illustrates a double lock cylinder with a housing 18 in which cylinder cores 19, 20 are situated. The cylinder cores 19, 20 are held together in an axial direction by a longitudinally split in half, lock web ring 21 having upstanding shoulders 22 at either axial end. A web area 23 of the lock web ring provides the means for holding together one side of the split lock web ring 21 as seen in greater detail in FIGS. 2–6. Coupling parts 24, 25 at either side of the double lock cylinder are actuated by a key 26 which is shown being inserted at the right hand cylinder core 20 and coupling to the lock web ring 21.

Figure 2:
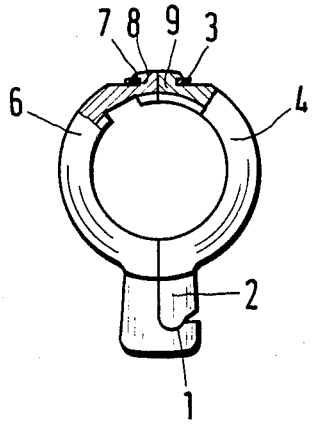
FIG. 2 is an end view, partially in section, of the lock web ring.

In order to delay introduction of the lock web ring until the end of assembly of the lock cylinder, the lock web ring is sub-divided in a longitudinal direction along a central longitudinal section plane into two parts or halves, as shown in FIGS. 2 through 6. In FIG. 2, the two parts are comprised of ring parts or elements 4, 6. These parts form an articulation in the lock web in the form of an open hinge at 1 and 2. When the lock web ring is pivoted into a closed position, as shown in FIG. 2, the parts 4, 6 are held together at the articulation by an interlocking connection at 1 and 2. When the lock web ring is pivoted into an open position, as shown in FIG. 6, the parts 4, 6 can be released and separated at the articulation in a radial direction. The two parts 4, 6 are clamped at a side opposite the web 23 by means of pegs or protrusions 8, 9 which project from the elements 4, 6 in a radial direction such that a lug or washer 3 with a central opening can be placed over the pegs to provide a clamping and retaining action. The washer 3 extends only a short distance to either side of the pegs. To ensure that the lug or washer 3 will remain in place on the pegs 8, 9 it may be useful to swedge the top of the pegs as shown in 7.

Figure 3:
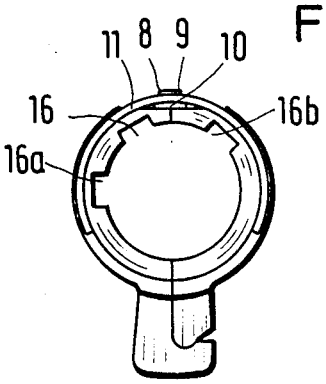
FIG. 3 is an end view of a lock web ring with a modified clamp.

FIG. 3 illustrates a modification of the clamping means in which a clamp or clasp 11 is utilized which has a central opening similar to the lug or washer 3 of FIG. 1 to capture and clamp the pegs 8, 9 of the lock web ring. The clamp or clasp 11 is designed to surround a large part of the lock web ring in that the body of the clamp 11 extends more than 180° around the circumference of the lock web ring 21. The clamp is also preferably fabricated of a resilient material so it can be snapped onto the lock web ring and will remain on the ring, held by the resiliency of the clamp. Thus there would be no need for wedging the pegs. FIG. 3 also illustrates the provision of a plurality of lock ring recesses 16, **16*a*, 16*b*** which provide and permit special coupling and lock web orientations.

Figure 4:
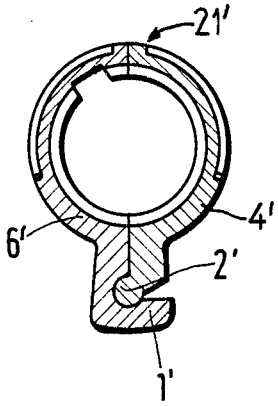
FIG. 4 is a end sectional view of a hinged lock web ring and clamp.

In FIG. 4, a captured hinge comprising a captured hinge pin 2' and a slot 1', is provided at the location of the articulation 1, 2 of FIG. 2. The hinge 1', 2' prevents separation of the elements 4', 6' in a radial direction even when the lock web ring 21' is in an open position. The elements 4', 6' can, however, be separated in an axial direction by sliding the pin 2' out of the slot 1'. The clamp or clasp 11 shown in FIG. 3 is used to provide the necessary clamping and retaining action.

Figure 5:
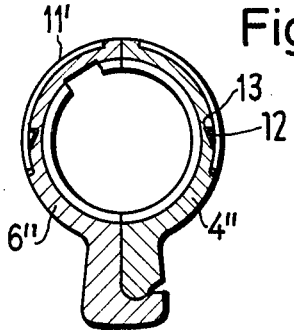
FIG. 5 is an end sectional view of a lock web ring with a modified clamp.

In FIG. 5, a clamp or clasp 11' shown having latch cogs 12 which project radially inwardly and engage into corresponding recesses 13 in the elements 4'', 6'' of the lock web ring. The latch cogs 12 provide positive engagement with the recesses 13 to further ensure that the clamp or clasp 11 will be retained on the lock web ring.

The assembly of the clamp or clasp 11' onto the lock web ring is shown in FIG. 6 where it is seen that the lock web ring 21 is in an open position and must be pivoted to a closed position as is shown by arrow 30 and then the clamp or clasp 11' can be snapped onto the lock web ring 21 in the direction shown by arrow 31.

In lieu of providing latch cogs and recesses, a clamp or clasp 11'' is illustrated in FIG. 7 in which the main body of the clamp has a plurality of openings 27 which improve the resilient spring properties of the clamp thus permitting it to be more resilient and to hold itself onto the lock web ring without the need for the latch cogs and recesses.

A modification is shown in FIG. 8 in which a clamp or clasp 11''' is illustrated which has two spring arms 28 at either lateral side of the clamp to provide an improved spring action also obviating the need for the latch cogs and corresponding recesses.

As is apparent from the foregoing specification, the invention is susceptible of being embodied with various alterations and modifications which may differ particularly from those that have been described in the preceeding specification and description. It should be understood that we wish to embody within the scope of the patent warranted hereon all such modifications as reasonably and properly come within the scope of our contribution to the art.

We claim as our invention:

1. In a lock cylinder, an improved lock web ring and retaining means comprising:

a lock web ring divided in a longitudinal direction forming two adjoining halves with a hinge connection between said two halves in the region of a lock web and having a radially projecting peg on each half at a region opposite said lock web; and a retaining means having a central opening selectively placeable over said pegs to hold said two pegs together in a clamped manner.

2. An apparatus according to claim 1, wherein said hinge connection is in the form of a captured hinge pin and slot.

3. An apparatus according to claim 1, wherein said retaining means comprises a washer extending only a short distance to either side of said pegs.

4. An apparatus according to claim 1, wherein said retaining means comprises a clamp member extending more than 180° around said lock web ring.

5. An apparatus according to claim 4, wherein said clamp member is fabricated of a resilient material to provide a clamping and retaining action.

6. An apparatus according to claim 5, wherein radially inwardly extending latch projections are provided on said clamp member and recesses are provided in said lock web ring, said projecton engaging said recesses to ensure a positive retaining action.

7. An apparatus according to claim 5, wherein said clamp member has a plurality of openings therethrough to improve the resiliency and clamping action of said member.

8. An apparatus according to claim 5, wherein said clamp member has a pair of spaced spring legs at either end to improve the resiliency and clamping action of said member.

9. In a lock cylinder, an improved lock web ring and retaining means comprising:

a lock web ring divided in a longitudinal direction forming two adjoining halves with a releasable interlocking connection formed between said two halves at a first region of said ring and having a radially projecting protrusion on each half at a region radially opposite said first region; and a retaining means having a central opening selectively placeable over said protrusions to hold said two protrusions together in a clamped manner.

10. An apparatus according to claim 9, wherein said interlocking connection is in the form of a separable hinge.

11. An apparatus according to claim 10, wherein said hinge is separable in an axial direction.

12. An apparatus according to claim 10, wherein said hinge is separable in a radial direction.

13. An apparatus according to claim 9, wherein said retaining means comprises a washer extending only a short distance to either side of said protrusions.

14. An apparatus according to claim 9, wherein said retaining means comprises a clamp member extending more than 180° around said lock web ring.

15. An apparatus according to claim 14, wherein said clamp member is fabricated of a resilient material to provide a clamping and retaining action.

16. An apparatus according to claim 15, wherein radially inwardly extending latch projections are provided on said clamp member and recesses are provided in said lock web ring, said projection engaging said recesses to ensure a positive retaining action.

17. An apparatus according to claim 15, wherein said clamp member has a plurality of openings therethrough to improve the resiliency and clamping action of said member.

18. An apparatus according to claim 15, wherein said clamp member has a pair of spaced spring legs at either end to improve the resiliency and clamping action of said member.

* * * * *